United States Patent [19]

Hagihara et al.

[11] Patent Number: 4,849,791

[45] Date of Patent: Jul. 18, 1989

[54] WASTE TONER COLLECTING SYSTEM

[75] Inventors: Hideaki Hagihara, Nara; Takahiro Fukunaga, Nara; Kozo Takahashi, Nara; Shoichiro Yoshiura, Yamatokoriyama, all of Japan

[73] Assignee: Sharp Kabushiki Kaisha, Osaka, Japan

[21] Appl. No.: 69,707

[22] Filed: Jul. 2, 1987

[30] Foreign Application Priority Data

Jul. 4, 1986 [JP] Japan ..... 61-158431

[51] Int. Cl.[4] ..... G03G 21/00

[52] U.S. Cl. ..... 355/298; 355/260; 355/215

[58] Field of Search ..... 355/3 DD, 15; 222/DIG. 1

[56] References Cited

U.S. PATENT DOCUMENTS 4,522,487 6/1985 Misawa ..... 355/15

FOREIGN PATENT DOCUMENTS 3020610 12/1980 Fed. Rep. of Germany .
58-37678 3/1983 Japan .
58-95773 6/1983 Japan ..... 355/15
59-84280 5/1984 Japan .
60-41079 3/1985 Japan .
60-134273 7/1985 Japan ..... 355/3 R
60-164761 8/1985 Japan .
60-168159 8/1985 Japan .
60-230173 11/1985 Japan ..... 355/3 DD
60-233678 11/1985 Japan .

*Primary Examiner*—Arthur T. Grimley
*Assistant Examiner*—Joan Pendegrass
*Attorney, Agent, or Firm*—Birch, Stewart, Kolasch & Birch

[57] ABSTRACT

A waste toner collecting system in an image forming apparatus which forms on the surface of an image carrier an electrostatic latent image corresponding to an original image, develops the latent image with toner and transferrs the toner image onto a copy material. The waste toner collecting system comprises a cleaning unit for removing residual toner from the image carrier after the toner image has been transferred, a container, independent of the cleaning unit, for storing the removed waste toner, and a transport device for conveying the waste toner removed by the cleaning unit to the container, with an outlet formed in the toner transport device so as to discharge the waste toner, a waste toner inlet formed in the container at a position corresponding to the outlet in the toner transport device, and shutter members provided for the outlet and the inlet, respectively, the shutter members being opened or closed according to as the waste toner container is mounted or dismounted.

2 Claims, 5 Drawing Sheets

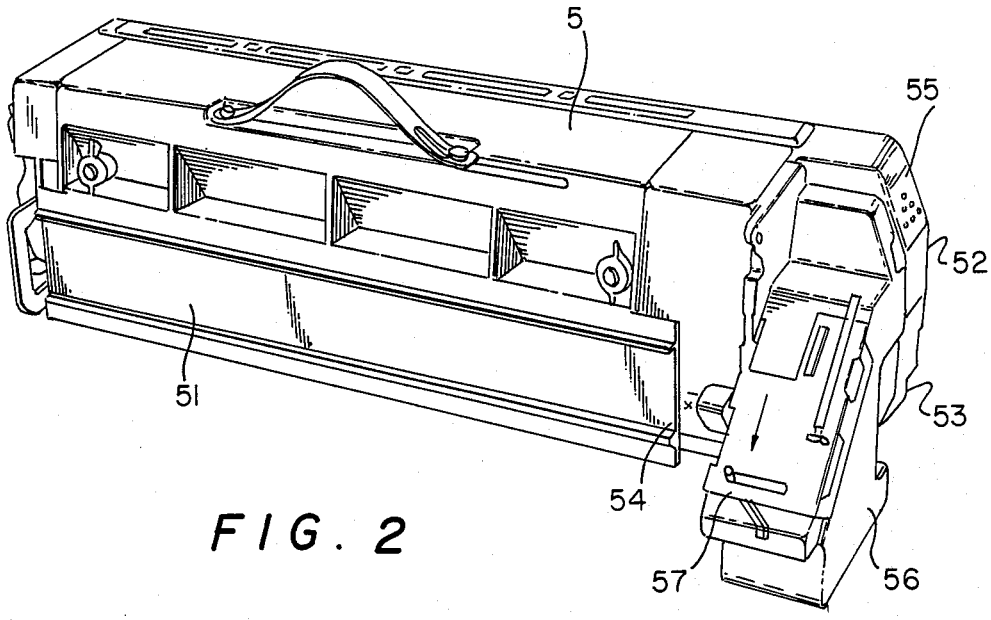
FIG. 2
FIG. 3
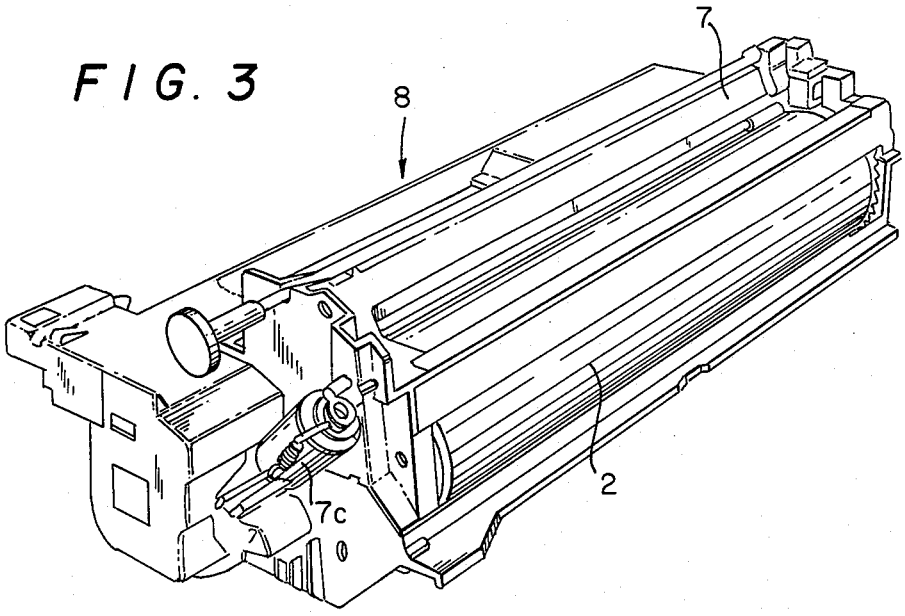

FIG. 6 (A)
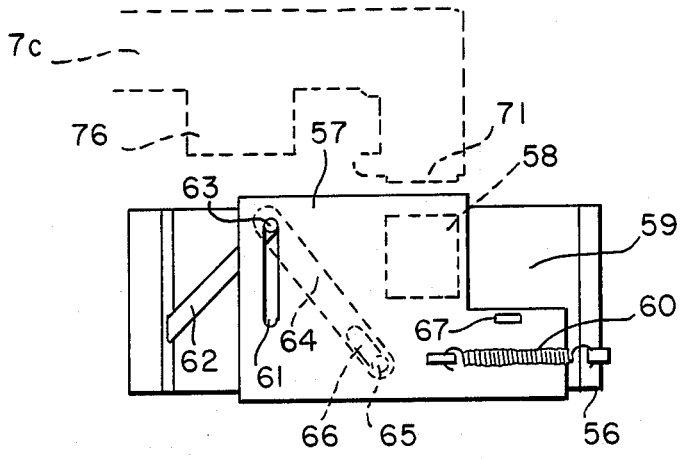
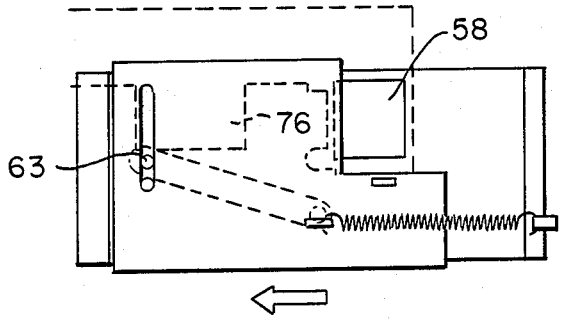
FIG. 6 (B)
FIG. 6 (C)
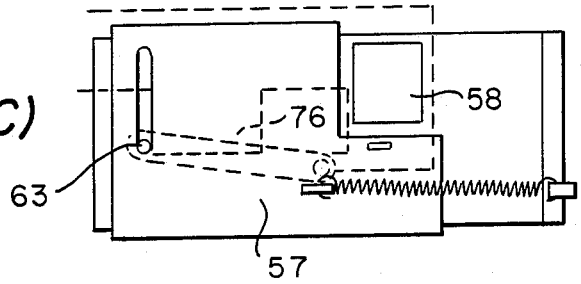

WASTE TONER COLLECTING SYSTEM

BACKGROUND OF THE INVENTION

The present invention relates to image forming equipment provided with a system for collecting the residual waste toner removed from the surface of an image carrier after an electrostatic latent image has been formed on the image carrier and made visible with toner and the toner image transferred onto a copying material. More specifically, the present invention relates to the specific waste toner container configuration for collecting the waste toner.

An image forming apparatus, such as an electronic photographic copying machine, forms an electrostatic latent image on a photoreceptor as an image carrier and develops the latent image by a developing unit. After the image made visible with toner is transferred onto a coying material, the residual toner on the image carrier is removed by a cleaning means, such as a cleaning or scraper blade. The waste toner thus removed is conveyed by transport means such as a screw to the exterior of the cleaning unit installed in the copying machine, and collected in a waste toner container positioned facing an outlet formed in the end portion of the transport means. With the above construction, it is easy to dismount the container for repair, maintenance or replacement when the container is full of waste toner. However, in disconnecting the waste toner container from the outlet of the transport means of the cleaning unit, waste toner tends to drop into the copying machine through these outlet, soiling the machine interior, which is a disadvantage of the conventional waste toner removal system.

SUMMARY OF THE INVENTION

The object of the present invention is to provide a waste toner collecting system for removing residual toner from an image carrier by a cleaning means and transporting the removed waste toner to a waste toner container, which system prevents the waste toner from dropping through or from the outlet of the transport means or from the inlet of the waste toner container when the container is dismounted, so as not to soil or contaminate the copying machine interior.

Briefly described, in accordance with the present invention, in a copying machine which has formed on the surface of an image carrier an electrostatic latent image corresponding to an original image, develops the latent image with toner and transferrs the toner image onto copying material, a waste toner collecting system is provided which comprises means for removing the residual toner from the image carrier surface after the toner image has been transferred, a waste toner container, independent of the toner-removing means, for storing the removed waste toner, and means for transporting the removed waste toner to the waste toner container, with an outlet formed in the transport means to discharge the waste toner, a waste toner inlet formed in the waste toner container at the position corresponding to the outlet, and shutter members provided for both the outlet and the inlet, respectively, so that the shutter members open the outlet and the inlet when the waste toner container is mounted into the copying machine, and close the outlet and the inlet, respectively when the container is dismounted.

BRIEF DESCRIPTION OF THE DRAWINGS

The present invention will become more fully understood from the detailed description given thereinbelow and the accompanying drawings which are given by way of illustration ony, and thus are not limitative of the present invention and wherein:

FIG. 2 is a perspective view of a second image forming unit;

FIG. 3 is a perspective view of a first image forming unit;

FIGS. 6(A) through 6(C) show a slidable cover provided on the waste toner container, illustrating how a shielding member of the slidable cover is opened.

DETAILED DESCRIPTION OF THE INVENTION

Figure 1:
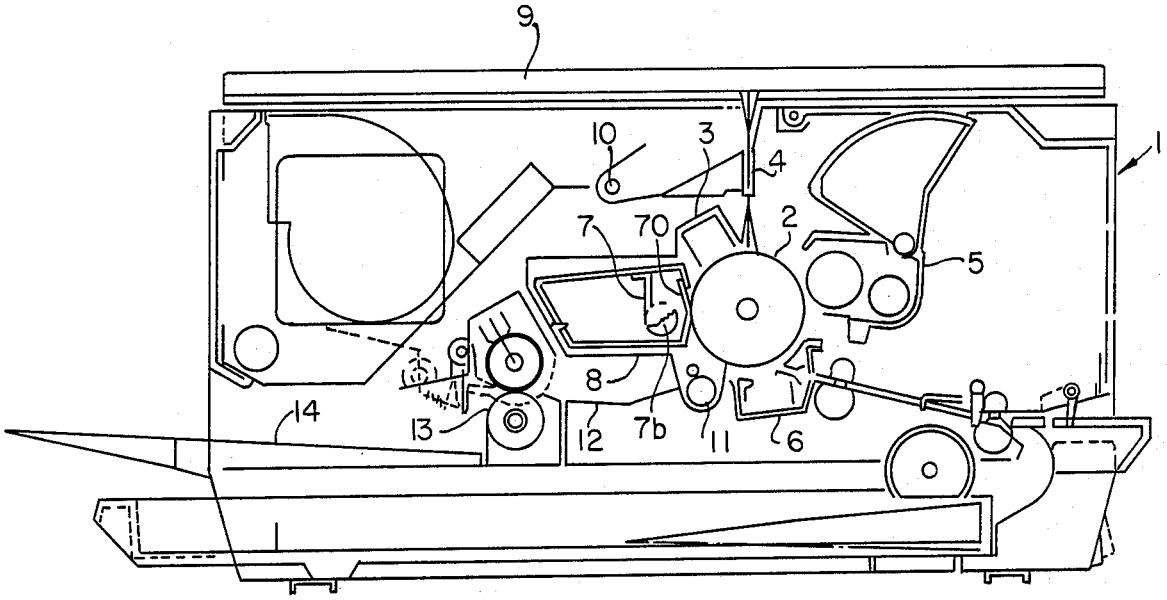
FIG. 1 is a schematic, sectional side elevation view of an electronic photographic copying machine related to the present invention.

FIG. 1 is a schematic, sectional side elevation of the electronic photographic copying machine related to the present invention. In the approximate center of the copying machine 1 is mounted a drum-shaped photoreceptor 2 for forming thereon a latent image. The photoreceptor 2 is held by a driving mechanism (not shown) in such a manner that it is rotatable clockwise. An electric charger 3, a convergent light transmitter 4, a developing unit 5, a transfer unit 6 and a cleaning unit 7 are arranged in this order in the rotary direction around the photoreceptor 2. The photoreceptor 2, the electric charger 3 and the cleaning unit 7 are retained in at least one housing, constituting a first image forming unit 8. The first image forming unit 8 is set on guide support means (not shown) formed in the copying machine so that is is easily dismounted from or mounted in the copying machine by a handle on the unit 8.

A manuscript rest 9 is movably provided on top of the copying machine 1. A manuscript is placed on the manuscript rest 9 to be exposed to an exposure light source 10. The manuscript rest 9 is laterally moved by a driving unit (not shown) for scanning. An optical image obtained by irradiating the manuscript with light from the exposure light source 10 is projected through the convergent light transmitter 4 onto the photoconductive layer on the surface of the photoreceptor 2, whereby an electrostatic latent image corresponding to the original image is formed on the surface of the photoreceptor 2. The latent image is made visible by the developing unit 5 which constitutes a second image forming unit.

The image made visible by the developing unit 5 (toner image) is transferred by the transfer unit 6 onto a copy paper which is fed from the paper feeder in a timely manner. Twenty percent of the toner is left on the photoreceptor surface. This residual toner must be removed to make the photoreceptor 2 ready for a subsequent copying operation. The cleaning unit 7 is provided for this purpose. The cleaning unit 7 contains an elastic cleaning blade 70 which is pressed against the surface of the photoreceptor 2 so as to scrape the residual toner off the rotating photoreceptor 2. The residual toner thus removed by the cleaning blade 70 drops on a waste toner receiver means 7*a* located under the cleaning blade 70. A waste toner transport means 7*b* is rotatably provided at a position near the waste toner receiver means 7*a*, so that the transport means 7*b* conveys the waste toner dropped on the receiver means 7*a* in the same direction as the rotation of the photoreceptor 2 to a side portion of the first image forming unit. As shown in FIG. 3, a transport unit 7*c* containing a spiral transport means is provided at the side portion, communicating with the waste toner transport means 7*b*, so that the waste toner is conveyed by a transport unit 7*c* in the direction vertical to the transportation by the waste toner transport means 7*b*. The transport unit 7*c* faces a waste toner container 56 (described later) mounted intergrally with the developing unit 5 (FIG. 2). More specifically, an outlet 72 (FIG. 7) formed in the transport unit 7*c* faces an inlet formed in the waste toner container 56.

Meanwhile, the copy paper, to which the toner image is transferred at the transfer position, is peeled off the photoreceptor 2 by a separator unit 11 and directed along a carriage guide 12 to a thermal fixing device 13 where the toner image is fixed on the copy paper by using heat and pressure. Then, the copy paper with the image fixed thereon is transported to a discharge tray 14.

FIG. 2 is a perspective view of the entire second image forming unit comprising the developing unit 5 and the waste toner container 56. Prior to mounting the second image forming unit, a cover 51 over the developing opening must be removed to expose a magnetic toner brush provided on a developing sleeve. The second image forming unit is mounted in the specified place in the copying machine by a handle 52. A positioning boss 54 is locked in a positioning hole 8*a* (FIG. 4) formed in the first image forming unit 8. A locking claw 53 is provided which secures the developing unit 5 to the copying machine 1. Color indicator 55 tells the operator the toner color in the mono-color copying operation. The color indicator 55 can be viewed through a window 1*b* (FIG. 4) provided in a front cabinet 1*a* (FIG. 4) of the copying machine. The waste toner container 56 stores waste toner transported from the first image forming unit 8 via the transport unit 7*c*. The container 56 is held integrally with the developing unit 5 so that they can be replaced at any time. A slidable cover 57 provides a shutter mechanism for the waste toner inlet 58 (FIG. 6). When the second image forming unit is mounted in the copying machine, the slidable cover 57 moves in the direction indicated by the arrow (FIG. 2) to open the waste toner inlet 58. When the second image forming unit is dismounted from the copying machine, the slidable cover 57 closes the waste toner inlet 58, preventing waste toner from dropping out of the second image forming unit. The position of the waste toner inlet 58 is such that it meets or is positioned opposite the outlet 72 (See FIG. 7.) in the transport unit 7*c* of the first image forming unit when both the first and second image forming unit are mounted.

Next, the opening mechanism of the slidable cover 57 is described in detail below. As shown in FIG. 6(A), the slidable cover 57 is mounted at a position corresponding to the inlet 58 of the waste toner container 56 and is slidable on the container 56 by means of guide members. The slidable cover 57 has a cutaway portion 59 corresponding to the waste toner inlet 58. A spring 60 is provided between the cover 57 and the container 56 so that the cover 57 is forced to close the inlet 58 at all times.

A slide slot 61 is formed in the slidable cover 57, enabling the slidable cover 57 to move in a direction opposite from the spring 60, thereby opening the inlet 58 of the waste toner container 56. A guide groove 62 for guiding a moveable pin 63 is formed obliquely in the container 56 to correspond with the slot 61. The movable pin 63 is guided with one end sliding in the guide groove 62 and with the other end sliding in the slot 61. The movable pin 63 is fixed to an end portion of an arm member 64 provided between the container 56 and the slidable cover 57. On the other end of the arm member 64 is fixed a fulcrum pin 65 which is fitted in a slot 66 formed in the waste tone container 56. The fulcrum pin 65 ensures the stable movement of the movable pin 63 in the guide groove 62. The slot 66 helps the movable pin 63 move in the guide groove 62.

When the movable pin 63 is pressed down along the slide slot 61, the moveable pin 63 moves down in the slide slot 61 and simultaneously in the guide groove 62 as well, causing the slidable cover 57 to move against the force of the spring 60. Thus, the waste toner inlet 58 is exposed as the cutaway portion 59 of the slidable cover 57 coincides with the inlet 58. When the movable pin 63 is released, the slidable cover 57 moves in the direction for closing the inlet 58 due to the force of the spring 60. The slidable cover 57 has a projection 67 which works to open another slidable cover 71 provided on the outlet 72 of the transport unit 7*c*.

FIG. 3 is a perspective view of the entire first image forming unit 8 which can be removably mounted in the copying machine. As mentioned earlier, the first image forming unit 8 comprises the photoreceptor 2 and the cleaning unit 7 accommodated in at least one housing. Waste toner scraped off the photoreceptor surface by the cleaning unit 7 is carried by the transport means 7*b* to the side portion of the first image forming unit 8 and then by the transport unit 7*c* to be discharged through the outlet 72 of the transport unit 7*c*. The transport unit 7*c* is equipped with a cover 71 slidable to open the outlet 72. When the second image forming unit is set in its proper position in the copying machine, the slidable cover 57 on the waste toner container 56 in the unit is moved to open the inlet 58, and then the slidable cover 71 is moved to open the outlet 72. The outlet 72 of the transport unit 7*c* is located to coincide with the inlet 58 of the waste toner container 56 in the second image forming unit.

Figure 7:
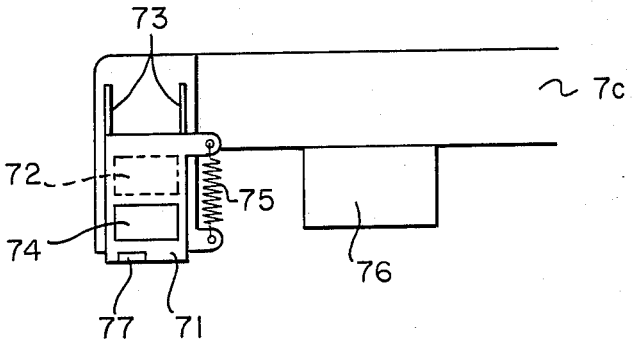
FIG. 7 is a plan view of a slidable cover provided on the transport means conveying waste toner to be discharged through the outlet.

The cover 71 is, as shown in FIG. 7, slidable on guide means 73 so as to open or close the outlet 72 of the transport unit 7*c*. The slidable cover 71 has an opening 74 for the outlet 72. A spring 75 is provided between the slidable cover 71 and the transport unit 7*c* so that the outlet 72 is normally closed by the cover 71. The slidable cover 71 is maintained at the position shown in FIG. 7 due to a stopper (not shown). A protrusion 76 is formed integrally with the transport unit 7*c* at a position corresponding to the movable pin 63 which moves the slidable cover 57 to open. The slidable cover 71 has a projection 77 at the position corresponding with the projection 67 on the slidable cover 57. When the slidable cover 57 on the waste toner container 56 opens, the projection 67 engages the projection 77 on the slidable cover 71.

Figure 4:
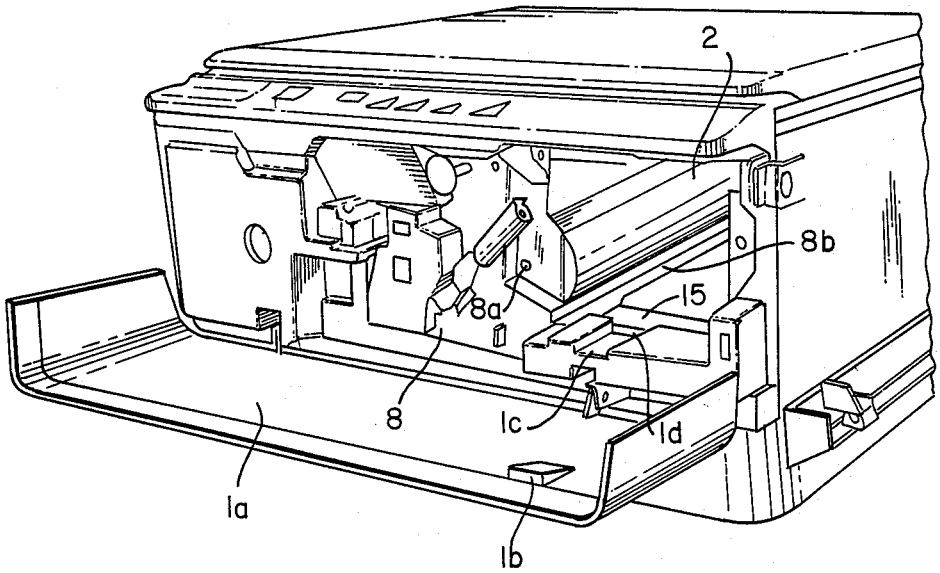
FIG. 4 is a perspective view of a copying machine without the second image forming unit being mounted.

Here, it must be noted that the second image forming unit can not be mounted in the copying machine prior to the first image forming unit 8. This is because a guideway means for mounting the second image forming unit is not formed until the first image forming unit 8 has been set in its place. As the guideway means, the first image forming unit 8 is provided with a guide 8*b* shown in FIG. 4. The guide 8*b* not only leads the second image forming unit to its proper position but also serves to position the magnetic toner brush accurately in relation to the photoreceptor 2 together with the positioning boss 54 on the second image forming unit. FIG. 4 shows the copying machine in which only the first image forming unit 8 is mounted.

The procedure of mounting the second image forming unit is as follows. It is assumed that the first image forming unit 8 has been set in the copying machine 1. The second image forming unit is inserted in the copying machine 1 with the bottom of the unit sliding along a guideway 1*c* comprising a part of the frame of the copying machine. The second image forming unit is led by the guide 8*b* formed on the first image forming unit 8 into the copying machine where it is coupled with the driving means (not shown) of the developing unit. Simultaneously, the positioning boss 54 of the second image forming unit is fit and locked in the positioning hole 8*a* of the first image forming unit 8. The second image forming unit, if left as it is, might come off the copying machine because it is not restricted in its movement in the insertion direction. To prevent the unit from coming off, the locking claw 53 of the second image forming unit engages with an edge 1*d* of the guide 1*c* on the copying machine frame.

Figure 5:
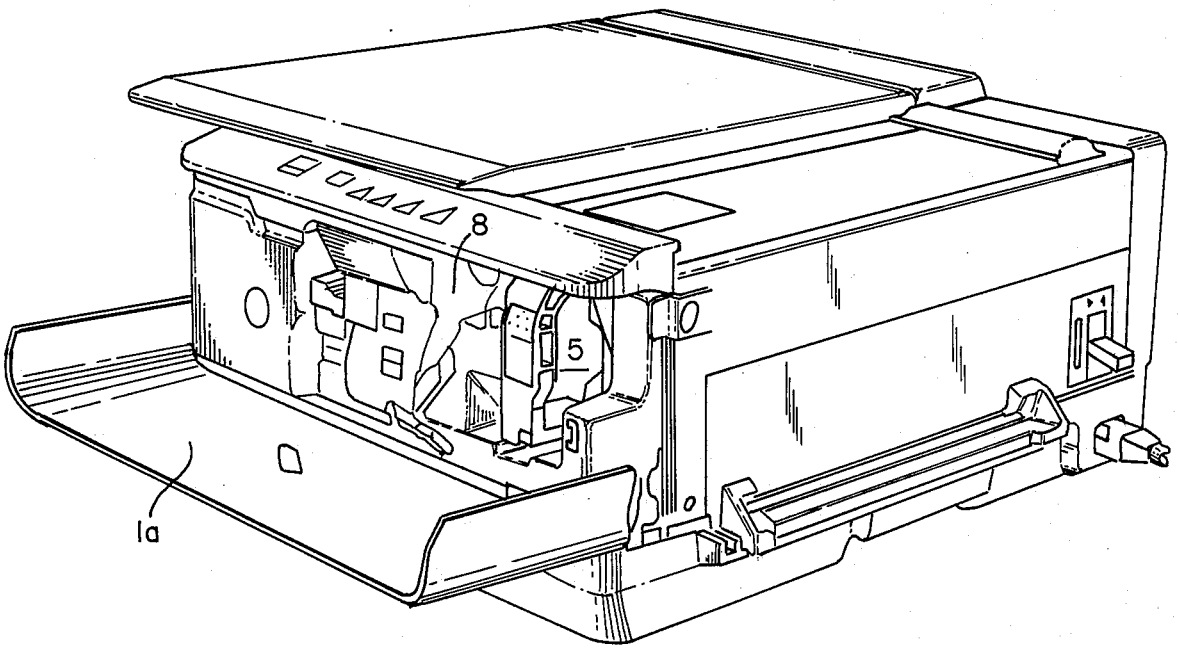
FIG. 5 is another perspective view of the copying machine in which both the first and the second image forming units are mounted.

When the second image forming unit has been mounted, the slidable cover 71 on the transport unit 7*c* of the first image forming unit 8 and the slidable cover 57 on the waste toner container 56 of the second image forming unit are moved so as to open the outlet 72 and the inlet 58, respectively, so that the transport unit 7*c* communicates with the waste toner container 56, permitting waste toner to be transferred to the container 56. FIG. 5 shows the copying machine in which the two image forming units are mounted.

The second image forming unit is thus positioned accurately with respect to the first image forming unit 8. Residual waste toner removed from the photoreceptor 2 is carried by the aforementioned various conveyance means and collected in the waste toner container 56 in the second image forming unit as long as the copying machine is operated. When the service life of the second image forming unit including the developing unit 5 has expired, such as when toner in the developing unit 5 has been used up, the operator is required to replace only the second image forming unit. By doing so, the waste toner container 56 held integrally with the second image forming unit can be replaced simultaneously. According to the present invention, therefore, the replacement procedures are very simple.

FIGS. 6(A) through 6(C) explain how the slidable cover on the waste toner container is opened by mounting the second image forming unit.

FIG. 6(A) shows the state of the slidable cover on the waste toner container of the second image forming unit when the unit is about to be mounted. In this state, the slidable cover 57 is held by the spring 60 to close the inlet 58. As the unit is being inserted, the movable pin 63 on the waste toner container 56 comes in contact with the protrusion 76 (FIG. 7) formed on the transport unit 7*c* of the first image forming unit 8.

In FIG. 6(B), the protrusion 76 of the first image forming unit 8 is pressing the movable pin 63 of the container 56 whereby the slidable cover 57 starts opening. Supported by the arm member 64 rotatable about the fulcrum pin 65 fit in the slot 66, the movable pin 63 moves in the guide groove 62 on the waste toner container 56 as well as in the slide slot 61 in the slidable cover 57. Eventually, the cutaway portion 59 meets the inlet 58, exposing the inlet 58.

In FIG. 6(C), the mounting of the second image forming unit is almost completed so that the inlet 58 is completely open. The movable pin 63 is now located on the side of the protrusion 76 of the first image forming unit 8, retaining the slidable cover 57 in its open position. In this state, the projection 67 on the slidable cover 57 comes in contact with the projection 77 on the slidable cover 71 provided at the end of the transport unit 7*c* of the first image forming unit 8. When the second image forming unit (or the waste toner container 56) is further inserted to its specified position, the slidable cover 71 is pressed by the projection 67 and moved against the force of the spring 75. Finally, the outlet 72 is exposed when the opening 74 coincides with the outlet 72.

Meanwhile, the slidable cover 57 is maintained at the same position while the slidable cover 71 is being opened, because the movable pin 63 moves only along the side of the protrusion 76.

When the second image forming unit is dismounted, in contrast, the waste toner outlet 72 of the transport unit 7*c* is first closed by the slidable cover 71 due to the spring force, before the inlet 57 of the container 56 is closed by the slidable cover 57.

In the above embodiment, as understood, the waste toner container 56 is mounted integrally with the developing unit so that the container 56 is replaced together with the developing unit. Alternatively, the waste toner container 56 may be designed to be removable from the developing unit, enabling the container 56 alone to be replaced. In this case, the slidable covers 57 and 71 are operated according to as the container 56 is mounted or dismounted. Specifically, the slidable cover 57 opens prior to the slidable cover 71 when the waste toner container 56 is mounted. The slidable covers 57 and 71 constituting the shutter members need not be always operated mechanically as in the above embodiment, provided that they are operated in relation to the replacement operation of the waste toner container 56. The slidable covers 57 and 71 may be operated by using solenoids. In this case, the solenoids must be controlled on the basis of detection whether or not the container 56 is mounted.

As appreciated from the above, according to the present invention, waste toner remaining on the image carrier is removed by the cleaning means and transported by the conveyance means to the waste toner container. The slidable shutter members provided on the outlet of the conveyance (transport) means and on the inlet of the waste toner container, respectively, are opened or closed according to as the waste toner container is mounted or dismounted. Consequently, the prevent invention prevents waste toner from dropping and soiling or contaminating the interior and the surrounding portions of the copying machine when the container is mounted or dismounted.

While only certain embodiments of the present invention have been described, it will be apparent to those skilled in the art that various changes and modifications may be made therein without departing from the spirit and scope of the present invention as claimed.

What is claimed is:

1. A waste toner collecting system for an image forming apparatus which forms an electrostatic latent image on the surface of an image carrier, develops the latent image with toner and transfers the toner image onto copy material, said waste toner collecting system, comprising:

means for removing residual waste toner from said image carrier;

a container, independent of said toner-removing means, for storing said removed waste toner, said container having a waste toner inlet formed therein;

transport means for conveying said waste toner removed by said toner-removing means to said container, said transport means having an outlet formed therein for discharge of said waste toner at a position corresponding to said waste toner inlet; and shutter members provided for each of said transport means outlet and said waste toner inlet, respectively, said shutter members being opened or closed accordingly as said waste toner container is either mounted to or dismounted from said image forming apparatus such that said shutter member of said waste toner container opens prior to opening of said shutter member on said transport means when said waste toner container is mounted on said image forming apparatus, whereas said shutter member on said transport means closes prior to closing of said shutter member on said waste toner container when said waste toner contains is dismounted from said apparatus.

2. The waste toner collecting system of claim 1, wherein said shutter member of said waste toner container has a projection which engages a corresponding projection of said shutter member of said transport means upon the opening of said shutter member of said waste toner container so as to synchronously open said shutter member of said transport means.

* * * * *